US010395521B2

(12) United States Patent
Bansal et al.

(10) Patent No.: US 10,395,521 B2
(45) **Date of Patent: *Aug. 27, 2019**

(54) TRAFFIC MANAGEMENT BASED ON BASIC SAFETY MESSAGE DATA

(71) Applicant: TOYOTA JIDOSHA KABUSHIKI KAISHA, Toyota-shi, Aichi-ken (JP)

(72) Inventors: Gaurav Bansal, Mountain View, CA (US); Hongsheng Lu, Mountain View, CA (US); John Kenney, Mountain View, CA (US); Toru Nakanishi, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/912,297

(22) Filed: Mar. 5, 2018

(65) Prior Publication Data

US 2018/0204449 A1 Jul. 19, 2018

Related U.S. Application Data

(63) Continuation of application No. 15/077,727, filed on Mar. 22, 2016, now Pat. No. 9,940,832.

(51) Int. Cl.

| | |
|---|---|
| ***G08G 1/01*** | (2006.01) |
| ***G08G 1/08*** | (2006.01) |
| ***G08G 1/052*** | (2006.01) |

(52) U.S. Cl.

CPC ..... *G08G 1/0145* (2013.01); *G08G 1/0112* (2013.01); *G08G 1/0125* (2013.01); (Continued)

(58) Field of Classification Search

CPC .. G08G 1/0145; G08G 1/0125; G08G 1/0133; G08G 1/0129; G08G 1/0112; G08G 1/08; G08G 1/052

See application file for complete search history.

(56) References Cited

U.S. PATENT DOCUMENTS 7,167,104 B2 * 1/2007 DiPiazza ..... G08G 1/052 340/539.1

7,523,000 B2 4/2009 Tengler et al.

(Continued)

FOREIGN PATENT DOCUMENTS

JP 2001-134900 5/2001

JP PO2003-248891 9/2003

(Continued)

OTHER PUBLICATIONS

Jiang et al., "Design of 5.9GHz DSRC-based Vehicular Safety Communication," IEEE Wireless Communication vol. 13—Issue 5, pp. 36-43, Oct. 2006, IEEE.

(Continued)

*Primary Examiner* — Frederick M Brushaber

(74) *Attorney, Agent, or Firm* — Burbage Law, P.C.; Jon-Michael Burbage; Elizabeth Ruzich

(57) ABSTRACT

The disclosure includes a system and method for managing traffic in a roadway system based on Basic Safety Message data ("BSM data") included in a set of Basic Safety Messages ("BSMs"). The method may include wirelessly receiving a set of BSMs describing a set of vehicles traveling along the roadway system. Each BSM included in the set of BSMs may describe a specific vehicle included in the set of vehicles, including that vehicle's lane, speed and heading of travel. The method may include analyzing the BSM data to determine whether there is an imbalance of traffic flow among a first set of vehicles traveling towards a first heading and a second set of vehicles traveling towards a second heading. The method may include determining that the bidirectional lane will be reconfigured so that traffic in the bidirectional lane flows towards the second heading based on the imbalance of traffic flow.

20 Claims, 12 Drawing Sheets

(52) U.S. Cl.
CPC ..... *G08G 1/0129* (2013.01); *G08G 1/0133* (2013.01); *G08G 1/052* (2013.01); *G08G 1/08* (2013.01)

(56) References Cited

U.S. PATENT DOCUMENTS

| | | | | |
|---|---|---|---|---|
| 8,473,144 | B1 | 6/2013 | Dolgov et al. | |
| 8,878,927 | B2 | 11/2014 | Richardson et al. | |
| 8,965,677 | B2 | 2/2015 | Breed et al. | |
| 9,754,325 | B1 | 9/2017 | Konrardy et al. | |
| 9,824,583 | B2 * | 11/2017 | Popple | G08G 1/096725 |
| 9,937,795 | B2 | 4/2018 | Konet et al. | |
| 9,940,832 | B2 * | 4/2018 | Bansal | G08G 1/0145 |
| 9,944,317 | B2 | 4/2018 | Lee | |
| 2005/0187701 | A1 * | 8/2005 | Baney | G08G 1/096716 701/117 |
| 2007/0109111 | A1 | 5/2007 | Breed et al. | |
| 2007/0152804 | A1 | 7/2007 | Breed et al. | |
| 2011/0009151 | A1 * | 1/2011 | Miucic | H04L 1/0006 455/522 |
| 2011/0128849 | A1 | 6/2011 | Guo | |
| 2013/0210460 | A1 * | 8/2013 | Subramanian | B61L 15/0027 455/456.3 |
| 2013/0279392 | A1 | 10/2013 | Rubin et al. | |
| 2013/0338877 | A1 | 12/2013 | Straus | |
| 2014/0045556 | A1 * | 2/2014 | Subramanian | H04W 52/0251 455/574 |
| 2014/0195102 | A1 * | 7/2014 | Nathanson | G07C 5/0808 701/31.4 |
| 2014/0236449 | A1 | 8/2014 | Horn | |
| 2014/0358414 | A1 | 12/2014 | Ibrahim et al. | |
| 2015/0025784 | A1 | 1/2015 | Kastner et al. | |
| 2015/0025789 | A1 | 1/2015 | Einecke et al. | |
| 2015/0170522 | A1 * | 6/2015 | Noh | G08G 1/096741 701/117 |
| 2015/0199905 | A1 * | 7/2015 | Hayee | G08G 1/22 701/118 |
| 2015/0224987 | A1 | 8/2015 | Tachibana | |
| 2015/0371538 | A1 * | 12/2015 | Eichhorst | G08G 1/087 340/906 |
| 2016/0001781 | A1 | 1/2016 | Fung et al. | |
| 2016/0027299 | A1 * | 1/2016 | Raamot | G08G 1/08 340/917 |
| 2016/0207530 | A1 | 7/2016 | Stanek et al. | |
| 2016/0231746 | A1 | 8/2016 | Hazelton et al. | |
| 2016/0375767 | A1 | 12/2016 | Konet et al. | |
| 2017/0032402 | A1 * | 2/2017 | Patsiokas | G06Q 30/0266 |
| 2017/0036673 | A1 | 2/2017 | Lee | |
| 2017/0124869 | A1 * | 5/2017 | Popple | G08G 1/096725 |
| 2017/0274820 | A1 | 9/2017 | Goudy et al. | |
| 2017/0274821 | A1 | 9/2017 | Goudy et al. | |
| 2017/0276504 | A1 * | 9/2017 | Lu | G01C 21/3415 |
| 2017/0278388 | A1 | 9/2017 | Bansal et al. | |
| 2017/0278401 | A1 | 9/2017 | Probert et al. | |
| 2017/0337816 | A1 | 11/2017 | Lu et al. | |
| 2017/0365166 | A1 | 12/2017 | Lu et al. | |
| 2017/0369055 | A1 | 12/2017 | Saigusa et al. | |
| 2018/0015918 | A1 | 1/2018 | Bae et al. | |
| 2018/0029533 | A1 | 2/2018 | Goudy et al. | |
| 2018/0050673 | A1 | 2/2018 | D'sa et al. | |
| 2018/0056999 | A1 | 3/2018 | Damiani et al. | |

FOREIGN PATENT DOCUMENTS

| | | |
|---|---|---|
| JP | PO2005-041432 | 2/2005 |
| JP | 2012-094135 | 5/2012 |
| JP | PO2015-022758 | 2/2015 |
| JP | PO2015-225558 | 12/2015 |

OTHER PUBLICATIONS

McGurrin, "Vehicular Information Exchange Needs for Mobility Applications," http://1.usa.gov/1EptYj5, pp. 1-46, downloaded on Mar. 22, 2016.
USPTO, U.S. Appl. No. 15/403,064, filed Jan. 10, 2017, 150 pages.
USPTO, Non-final Office Action for U.S. Appl. No. 15/403,064, dated May 17, 2018, 26 pages.
USPTO, Supplemental Notice of Allowability for U.S. Appl. No. 15/403,064, dated Feb. 25, 2019, 10 pages.
USPTO, Notice of Allowance for U.S. Appl. No. 15/403,064, dated Nov. 29, 2018, 15 pages.

* cited by examiner

198

Average Differential Speed Among Opposing Lanes of traffic ("ADSAOL")

For example, with reference to Figure 1A:

ADSAOL = Average North Speed – Average South Speed

- Ideally, ADSAOL = 0 or substantially 0.
- If ADSAOL > 0, then this indicates that traffic is traveling slower in the South-bound direction. Accordingly, the BSM Traffic Management System may determine that Lane #2 should be configured so that traffic flow in Lane #2 flows in the South-bound direction, thereby improving traffic flow in the South-bound direction.
- If ADSAOL < 0, then this indicates that traffic is traveling slower in the North-bound direction. Accordingly, the BSM Traffic Management System may determine that Lane #2 should be configured so that traffic flow in Lane #2 flows in the North-bound direction, thereby improving traffic flow in the North-bound direction.

Figure 1B

BSM DATA 195

- Vehicles and other client devices equipped with Direct Short Range Communication ("DSRC") transmit a Basic Safety Message ("BSM") at a regular interval.

- Each BSM includes the following BSM data describing one or more of the following for the vehicle that originally sent the BSM:
  (1) GPS Data Describing the Location of the Vehicle, where the GPS Data may be so accurate that it describes the specific lane the Vehicle is traveling in;
  (2) Heading Data Describing the Direction of travel for the Vehicle;
  (3) Velocity Data Describing the Velocity of the Vehicle; and
  (4) Path History of Vehicle.

Figure 2B

BSM DATA 195

Part 1

Vehicle Position Data (local 3D)

- Latitude
- Longitude
- Elevation
- Positional accuracy
- Time

Vehicle Motion Data

- Transmission state
- Speed
- Heading
- Steering wheel angle
- Acceleration set (4-way, i.e., 3 axes of acceleration plus yaw rate
- Brake system status Vehicle Size Data

Part 2

Vehicle Path History
Future Vehicle Path Estimation
Hard Active Braking
Traction Control System active over 100 milliseconds?
Antilock Brake System active over 100 milliseconds?
Light Status
Wiper Status
Vehicle type

Figure 2C

TRAFFIC MANAGEMENT BASED ON BASIC SAFETY MESSAGE DATA

CROSS-REFERENCE TO RELATED APPLICATIONS

This patent application is a continuation of U.S. patent application Ser. No. 15/077,727, entitled "Traffic Management Based on Basic Safety Message Data" filed on Mar. 22, 2016, the entirety of which is hereby incorporated by reference.

BACKGROUND

The specification relates to traffic management based on Basic Safety Message data ("BSM data").

Vehicles are increasingly being manufactured so that they include Dedicated Short Range Communication ("DSRC") capabilities. DSRC-equipped vehicles broadcast a Basic Safety Message ("BSM" if singular or "BSMs" if plural) at an adjustable rate. These BSM include Basic Safety Message data. The BSM data may describe attributes of the vehicle that originally transmitted the BSM.

SUMMARY

Disclosed are implementations for improving the flow of traffic on a roadway system using a set of BSMs received in real time from one or more vehicles on the roadway system that are equipped with DSRC. In some implementations, a BSM traffic management system improves the flow of traffic on the roadway system by providing improved management of (1) bidirectional lane switching systems or (2) ramp metering systems.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a method of managing traffic along a roadway system including a first unidirectional lane having traffic flowing towards a first heading, a second unidirectional lane having traffic flowing towards a second heading and a bidirectional lane that is configurable to have traffic flowing towards either the first heading or the second heading, where the first heading is different from the second heading and the bidirectional lane is presently configured so that traffic in the bidirectional lane flows towards the first heading, the method including: wirelessly receiving, by a BSM traffic management system, a set of BSMs describing a set of vehicles traveling along the roadway system, each BSM included in the set of BSMs describing a specific vehicle included in the set of vehicles and including basic safety message data describing a lane of travel for the specific vehicle, a speed of travel for the specific vehicle and a heading of travel for the specific vehicle; collating the BSM data into a plurality of subsets based on a portion of the BSM data describing the lane of travel, where the plurality of subsets includes a first subset including all the BSM data received for vehicles included in the set of vehicles traveling in the first unidirectional lane, a second subset including all the BSM data received for vehicles included in the set of vehicles traveling in the second unidirectional lane and a bidirectional subset including all the BSM data received for vehicles included in the set of vehicles traveling in the bidirectional lane; analyzing the BSM data included in each subset to determine a first value for an Average Differential Speed Among Opposing Lanes of traffic ("ADSAOL"), where the first subset and the bidirectional subset oppose the second subset since traffic in the first unidirectional lane and the bidirectional lane flows towards the first heading and traffic in the second unidirectional lane flows towards the second heading; analyzing the ADSAOL to determine whether reconfiguring the bidirectional lane so that traffic in the bidirectional lane flows in the second heading would result in a second value for the ADSAOL that is closer to zero when compared to the first value; and responsive to determining that reconfiguring the bidirectional lane so that traffic in the bidirectional lane flows towards the second heading would result in the second value for the ADSAOL being closer to zero when compared to the first value, providing, by the BSM traffic management system, a signal to a manager of the bidirectional lane to cause the bidirectional lane to be reconfigured so that traffic in the bidirectional lane flows towards the second heading. Other embodiments of this aspect include corresponding computer systems, apparatus, and computer programs recorded on one or more computer storage devices, each configured to perform the actions of the methods.

Implementations may include one or more of the following features. The method where at least one BSM in the set is wirelessly received by the BSM traffic management system via a DSRC message. The method where the DSRC message is transmitted by the specific vehicle that is described by the BSM data included in the BSM. The method where the DSRC message is transmitted by a different vehicle than the specific vehicle described by the BSM data included in the BSM. The method where at least one BSM included in the set of BSMs is received from a second BSM traffic management system via a DSRC message. The method where at least one BSM included in the set of BSMs is received from a second BSM traffic management system via a wireless network. The method where the second unidirectional lane includes a feeder point that delivers traffic traveling in the second unidirectional lane. The method where the bidirectional lane is only reconfigured if doing so would result in the second value being substantially zero. The method where at least one BSM in the set is wirelessly received by the BSM traffic management system via a DSRC message. The method where the DSRC message is transmitted by the specific vehicle that is described by the BSM data included in the BSM. The method where the DSRC message is transmitted by a different vehicle than the specific vehicle described by the BSM data included in the BSM. The method where at least one BSM included in the set of BSMs is received from a second BSM traffic management system via a DSRC message. The method where at least one BSM included in the set of BSMs is received from a second BSM traffic management system via a wireless network. The method where at least one of the first unidirectional lane and the second unidirectional lane includes a feeder point that delivers traffic traveling to that lane. The method where the bidirectional lane is only reconfigured if doing so would result in the feeder point not including one or more vehicles that are substantially stationary based at least in part on the imbalance. Other embodiments of this aspect include corresponding computer systems, apparatus, and computer programs recorded on one or more computer storage devices, each configured to perform the actions of the methods.

One general aspect includes a method of managing traffic along a roadway system including a first unidirectional lane having traffic flowing towards a first heading, a second unidirectional lane having traffic flowing towards a second heading and a traffic ramp that feeds traffic into the first unidirectional lane, where the first heading is different from the second heading and the traffic ramp includes a metering light to manage a flow of feeder vehicles fed into the first unidirectional lane, where the metering light is configured to allow a first rate of feeder vehicles to be fed into the first unidirectional lane per unit measurement of time, the method including: wirelessly receiving a set of BSMs describing a set of vehicles traveling along the roadway system, each BSM included in the set of BSMs describing a specific vehicle included in the set of vehicles and including BSM data describing a lane of travel for the specific vehicle, a speed of travel for the specific vehicle and a heading of travel for the specific vehicle; and analyzing, by a traffic management system, the BSM data to identify whether there is an imbalance of traffic flow among a first set of vehicles traveling towards the first heading and a second set of vehicles traveling towards the second heading; responsive to identifying the imbalance, determining a second rate of feeder vehicles to be fed into the first unidirectional lane per unit measurement of time, where the second rate is configured to improve the imbalance relative to the first rate; and providing a signal to the metering light that reconfigures the metering light to allow the second rate of feeder vehicles to be fed into the first unidirectional lane per unit measurement of time. Other embodiments of this aspect include corresponding computer systems, apparatus, and computer programs recorded on one or more computer storage devices, each configured to perform the actions of the methods.

Implementations may include one or more of the following features. The method where the analyzing includes (1) analyzing the BSM data to determine a value for an ADSAOL for the first unidirectional lane and the second unidirectional lane based on the BSM data and (2) determining that an imbalance is present if the value for the ADSAOL is greater than a number provided by a human administrator of the traffic management system. The method where the ADSAOL is determined in substantial real time relative to a time when the set of BSMs was received. The method where the signal to the metering light is provided via a DSRC message. Implementations of the described techniques may include hardware, a method or process, or computer software on a computer-accessible medium.

BRIEF DESCRIPTION OF THE DRAWINGS

The disclosure is illustrated by way of example, and not by way of limitation in the figures of the accompanying drawings in which like reference numerals are used to refer to similar elements.

FIG. 1B is a block diagram illustrating an example analysis for determining an ADSAOL according to some implementations.

FIG. 2B is a block diagram illustrating an example of BSM data according to some implementations.

FIG. 2C is a block diagram illustrating an example of BSM data according to some implementations.

DETAILED DESCRIPTION

Vehicles are increasingly equipped with Dedicated Short Range Communication ("DSRC"). A vehicle equipped with DSRC may be referred to as "DSRC-equipped." A DSRC-equipped vehicle may in a DSRC antenna and any hardware of software necessary to send and receive DSRC message, generate DSRC messages and read DSRC messages.

One type of DSRC message is known as a Basic Safety Message ("BSM" if singular or "BSMs" if plural). DSRC-equipped vehicles broadcast a BSM at a regular interval. The internal may be user adjustable. In some implementations, the BSM is broadcast at an adjustable rate of once every 0.10 seconds.

A BSM includes BSM data. The BSM data describes attributes of the vehicle that originally transmitted the BSM message. FIGS. 2B and 2C depict examples of BSM data according to some implementations. FIGS. 2B and 2C are described below.

A bidirectional lane is a lane of a roadway system in which traffic may travel in either direction, depending on certain conditions. Typically, bidirectional lanes are meant to improve traffic flow during rush hours by having overhead traffic lights and lighted street signs notify drivers which lanes are open or closed to driving or turning.

Bidirectional lanes may also commonly found in tunnels and on bridges, and on the surrounding roadways.

Bidirectional lanes include a lane control. The lane control allows roadway workers to close or reverse bidirectional lanes when circumstances (such as construction or a traffic mishap) may suggest use of fewer or more lanes to maintain an orderly flow of traffic.

Existing systems for managing bidirectional lanes work based on time of day. For example, a bidirectional lane may flow from South to North from 5 AM to 2 PM and then switch to flow from North to South from 2:01 PM to 4:59 AM. These time-based systems operate based on human assumptions of when rush hours will occur and the assumed relative flow of traffic among lane directions (or headings) during rush hour. By contrast, implementations of the BSM traffic management system described herein operate based on BSM data received in real time or substantially real time. As a result, the BSM traffic management system is more adaptive and responsive to real time events and roadway conditions.

System Overview

Figure 1A:
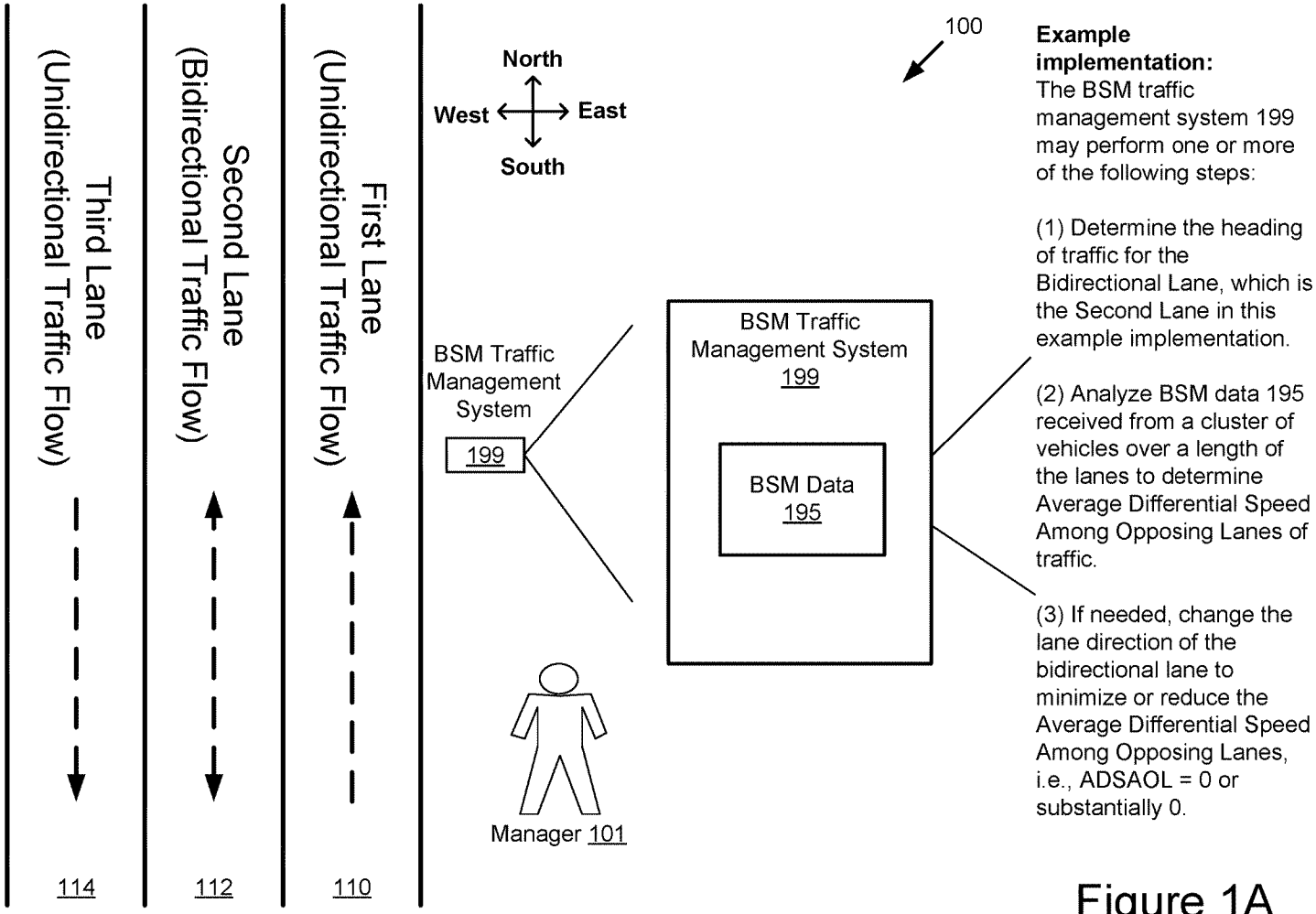
FIG. 1A is a block diagram illustrating a first example operating environment for a BSM traffic management system according to some implementations.

FIG. 1A is a block diagram illustrating a first example operating environment 100 for a BSM traffic management system 199 according to some implementations.

The illustrated operating environment 100 includes: a first lane 110 of a roadway system; a second lane 112 of the roadway system; a third lane 114 of the roadway system; and a BSM traffic management system 199. The first lane 110, second lane 112 and the third lane 114 may include one or more DSRC-equipped vehicles traveling along the roadway system. These vehicles (not pictured) may wirelessly transmit DSRC messages to other entities that are DSRC equipped. As described below with reference to FIG. 2A, in some implementations the BSM traffic management system 199 is DSRC-equipped. The vehicles may wirelessly broadcast a set of BSM data 195. The BSM traffic management system 199 may receive the set of BSM data 195. The BSM traffic management system 199 may store the BSM data 195 in a non-transitory memory. The non-transitory memory is described below with reference to FIG. 2A.

In the implementation depicted in FIG. 1A, the first lane 110 is a unidirectional lane with traffic flowing in the North direction (or "heading" North), the third lane 114 is a unidirectional lane with traffic flowing in the South direction and the second lane 112 is a bidirectional lane that can be configured by a human manager 101 so that traffic in the second lane 112 can flow in either the North or the South direction.

In some implementations, the manager 101 may include a roadway worker. In some implementations, the manager 101 may be associated with a roadway authority for a geographic area that includes the roadway system.

Although only one manager 101 is depicted in FIG. 1A, in practice the operating environment may include two or more managers 101. Similarly, although one first lane 110, one second lane 112 and one third lane 114 are depicted in FIG. 1A, in practice the operating environment 100 may include one or more first lanes 110, one or more second lanes 112 or one or more third lanes 114.

The headings (North, South, East and West) depicted in FIG. 1A are provided by way of example. For example, in FIG. 1A the first lane 110 is depicted with traffic flowing in a North direction, the third lane 114 is with traffic flowing in a South direction and the second lane is depicted so that traffic may flow in either North or South. However, in practice these lanes 110, 112, 114 may be configured so that traffic flows in different directions.

In some implementations, the manager 101 may include a human manager of the roadway system that includes the first lane 110, the second lane 112 and the third lane 114. The BSM traffic management system 199 may be included as an element of the roadway system.

In some implementations, the BSM traffic management system 199 may include a DSRC-equipped roadside unit that establishes a vehicle communication network (e.g., network 105 depicted in FIG. 4) shared with the DSRC-equipped vehicles traveling on the roadway system and within DSRC range of the BSM traffic management system 199.

In some implementations, the BSM traffic management system 199 may include a roadside unit configured to assist the managers of the roadway system to determine when a bidirectional lane such as the second lane 112 should be switched to a different lane direction (i.e., a different heading).

For example, assume the second lane 112 is configured so that traffic flows towards the South bound direction along with the third lane 114, in which traffic also flows South. Traffic in the first lane 110 flows in the North bound direction. Further assume that the average speed of vehicles traveling in the South bound direction is 80 kilometers per hour (approximately 50 miles per hour) and that the average speed of vehicles traveling North is 88 kilometers per hour (approximately 55 miles per hour). In other words, in this example the Average Differential Speed Among Opposing Lanes of traffic ("ADSAOL") is 8 kilometers per hour (or approximately 5 miles per hour). An example analysis for determining ADSAOL is described below with reference to FIG. 1B. Ideally, the ADSAOL is zero or substantially zero, thereby indicating balance among the opposing lanes of traffic. The DSRC-equipped vehicles traveling along the roadway system may broadcast BSMs that are received by the BSM traffic management system 199. Each BSM may include BSM data 195 describing one or more of the following regarding the vehicle that originally broadcasted the BSM: which lane the vehicle is traveling in (e.g., the first lane 110, the second lane 112 or the third lane 114); a heading of the vehicle (e.g., North or South); and a speed of the vehicle. The BSM traffic management system 199 may receive a set of BSM data 195. The set of BSM data 195 may include BSMs from the vehicles traveling along the roadway system that are in DSRC range of the BSM traffic management system 199. Since BSM messages are sent at regular intervals, the set of BSM data 195 may include multiple instances of BSM data 195 for the same vehicle. The BSM traffic management system 199 may provide the following example functionality: (1) determine a direction (or heading) of traffic for the bidirectional lane, which is the second lane 112 in this example; (2) analyze the set of BSM data 195 received from a cluster of vehicles over a length of the lanes 110, 112, 114 to determine the ADSAOL; and (3) if needed, change the lane direction (or heading) of the bidirectional lane, which is the second lane 112 in this example, to achieve one or more of the following goals: (a) minimizing the ADSAOL; (b) reducing the ADSAOL so that it is closer to zero than it would be if the direction (or heading) of the bidirectional lane was not changed; (c) achieve an ADSAOL equal to zero; (d) achieve an ADSAOL equal to substantially zero; and (d) achieve an ADSAOL equal to a number within a zero to five miles per hour (0 to 5 miles per hour) or zero to eight kilometers per hour (0 to 8 kilometers per hour).

In another example, assume that a large number (e.g., greater than 20) of the vehicles traveling along the first lane 110, the second lane 112 and the third lane 114 are equipped with DSRC. Each of these vehicles broadcast a BSM at some regular interval. For example, each of these vehicles broadcasts a BSM every 0.10 seconds. The BSM traffic management system 199 receives each of these BSMs while the vehicles that broadcast them are within DSRC range of the BSM traffic management system 199.

The BSM traffic management system 199 analyzes the BSM messages to determine the ADSAOL. Ideally, the ADSAOL is equal to zero or substantially equal to zero. When the ADSAOL is equal to zero or substantially equal to zero, the flow of traffic is balanced among the opposing lanes. For example, if ADSAOL equals zero in FIG. 1A, then there is an approximately equal flow of traffic flowing North and South.

Figure 2A:
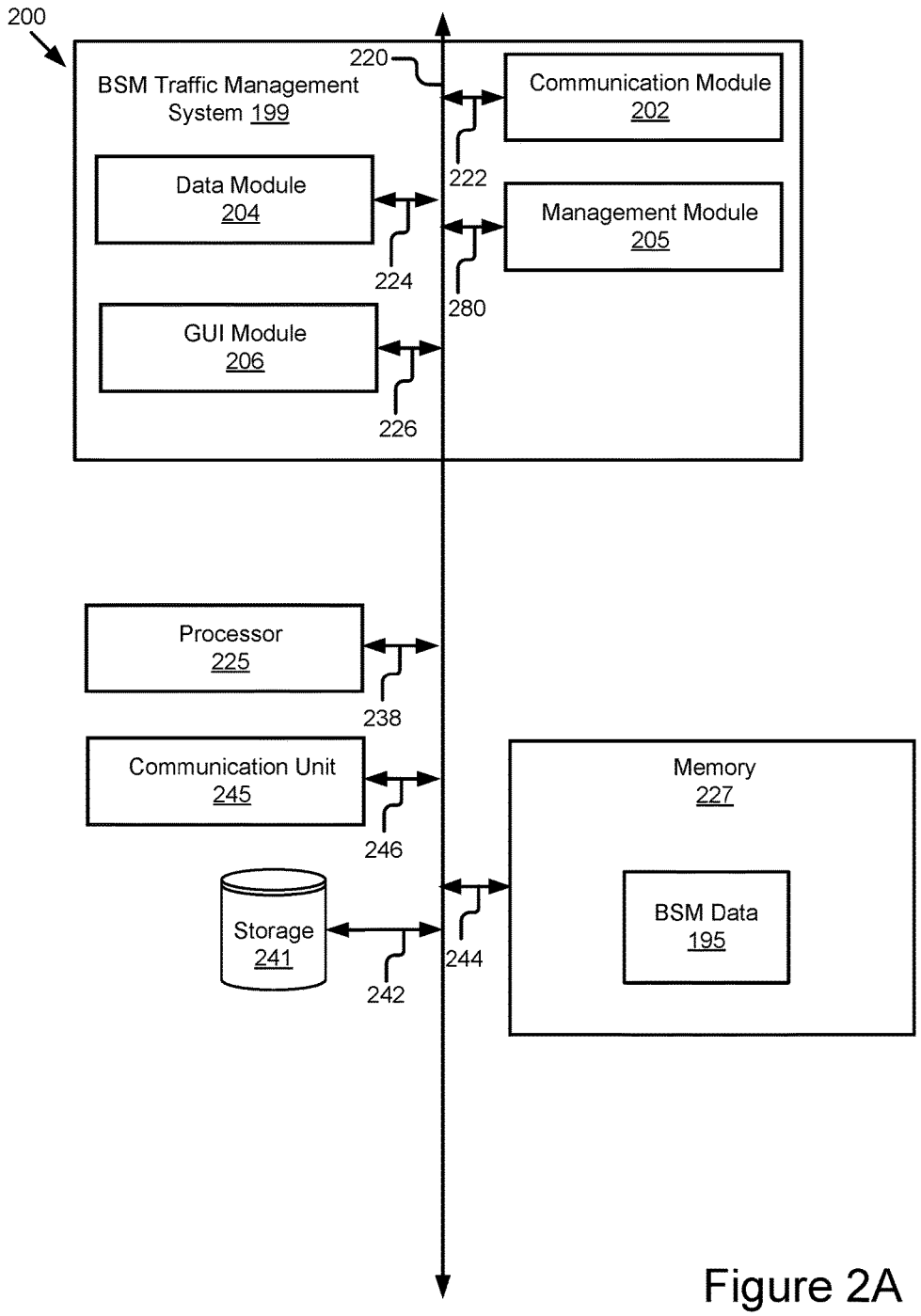
FIG. 2A is a block diagram illustrating an example computer system including the BSM traffic management system according to some implementations.

The BSM data 195 is described in more detail below with reference to FIGS. 1B, 2A-2C, 3A-3D and 4-6. Examples of the BSM data 195 are depicted in FIGS. 2B and 2C according to some implementations.

The operating environment 100 are described in more detail below with reference to FIGS. 1B, 2A-2C and 3A-3D.

The BSM traffic management system 199 is described in more detail below with reference to FIGS. 1B, 2A-2C, 3A-3D and 4-6.

Referring now to FIG. 1B, depicted is a block diagram illustrating an example analysis 198 for determining an ADSAOL according to some implementations.

The operating environment 100 described above with reference to FIG. 1A is referenced in the description of the analysis 198 by way of example to provide a better understanding of the analysis 198. Persons having ordinary skill in the art will appreciate how to conform the analysis to different operating environments 100 such as those described below and depicted in FIGS. 4-6.

The BSM traffic management system 199 receives BSMs from vehicles in each of the first lane 110, the second lane 112 and the third lane 114. For each vehicle, the BSM traffic management system 199 may receive multiple BSMs. Since each BSM includes speed data and heading data, the BSM traffic management system 199 may calculate an average speed for each heading (North and South in this example).

The BSM traffic management system 199 may determine the differential between the Average North Speed and the Average South Speed as follows:

ADSAOL=Average North Speed−Average South Speed

Ideally, ADSAOL is equal to zero or substantially equal to zero. However, this may not be possible.

If ADSAOL is greater than zero, then the BSM traffic management system 199 may determine that this indicates that traffic is traveling slower in the South-bound direction. Accordingly, the BSM traffic management system 199 may determine that second lane 112 (which is a bidirectional lane) may be configured so that traffic flow in in the second lane 112 flows in the South-bound direction, thereby improving traffic flow in the South-bound direction.

If ADSAOL is less than zero, then the BSM traffic management system 199 may determine that this indicates that traffic is traveling slower in the North-bound direction. Accordingly, the BSM traffic management system 199 may determine that the second lane 112 may be configured so that traffic flow in the second lane 112 flows in the North-bound direction, thereby improving traffic flow in the North-bound direction.

In some implementations, reconfiguring the bidirectional lane will change both North Average Speed and the South Average Speed, and could actually increase ADSAOL. Accordingly, the bidirectional lane may not be reconfigured until ADSAOL exceeds some threshold (positive or negative). The threshold may be predetermined by a human administrator of the BSM traffic management system 199. In some implementations, there may also be some hysteresis to prevent frequent reconfigurations of the bidirectional lane. Accordingly, another example analysis is described below in the following paragraph. In this example analysis, SHIFTTIME is a variable indicating the hysteresis to prevent frequent lane direction shifts of the bidirectional lane.

If (lane direction has not shifted within last interval SHIFTTIME)

If (ADSAOL≥Threshold) change bidirectional lane from North to South

Else if (ADSAOL≤Threshold) change bidirectional lane from South to North

Else do not change the heading of the bidirectional lane.

The analysis described in the preceding paragraph may be implemented by the BSM traffic management system 199 in order to determine whether to reconfigure the bidirectional lane. However, in some implementations, reconfiguration of the bidirectional lane is not done immediately since the bidirectional lane may first be emptied of traffic before allowing traffic to flow in the opposite direction.

Referring now to FIG. 2A, depicted is a block diagram illustrating an example computer system 200 including the BSM traffic management system 199 according to some implementations. The computer system 200 may include a roadside unit or some other computing device positioned on a roadside of a roadway system. The computer system 200 may include a traffic light, a traffic sensor or some other roadway computer device.

The computer system 200 may include the BSM traffic management system 199, a processor 225, a communication unit 245, a storage 241 and a memory 227 according to some examples. The components of the computer system 200 are communicatively coupled by a bus 220.

In the illustrated implementation, the processor 225 is communicatively coupled to the bus 220 via a signal line 238. The memory 227 is communicatively coupled to the bus 220 via a signal line 244. The communication unit 245 is communicatively coupled to the bus 220 via a signal line 246. The storage 241 is communicatively coupled to the bus 220 via a signal line 242.

The processor 225 includes an arithmetic logic unit, a microprocessor, a general purpose controller, or some other processor array to perform computations and provide electronic display signals to a display device. The processor 225 is coupled to the bus 220 for communication with the other components via signal line 238. The processor 225 processes data signals and may include various computing architectures including a complex instruction set computer (CISC) architecture, a reduced instruction set computer (RISC) architecture, or an architecture implementing a combination of instruction sets. Although FIG. 2A includes a single processor 225, multiple processors may be included. Other processors, operating systems, sensors, displays, and physical configurations may be possible.

The memory 227 stores instructions or data that may be executed by the processor 225. The memory 227 is coupled to the bus 220 for communication with the other components via signal line 244. The instructions or data may include code for performing the techniques described herein. The memory 227 may be a dynamic random access memory (DRAM) device, a static random access memory (SRAM) device, flash memory, or some other memory device. In some implementations, the memory 227 also includes a non-volatile memory or similar permanent storage device and media including a hard disk drive, a floppy disk drive, a CD-ROM device, a DVD-ROM device, a DVD-RAM device, a DVD-RW device, a flash memory device, or some other mass storage device for storing information on a more permanent basis.

As illustrated in FIG. 2, the memory 227 stores the BSM data 195. The BSM data 195 may include one or more sets of BSM data 195. Although not pictured in FIG. 2A, the memory 227 may store data describing the results of the analyses described herein or any other data necessary for the BSM traffic management system 199 to provide its function. The BSM data 195 is described in more detail below with reference to FIGS. 2B and 2C.

The communication unit 245 transmits and receives data to and from a network (e.g., the network 105 described below with reference to FIG. 4) or to another communication channel. The network or the communication channel may include DSRC. For example, the communication unit 245 may include a DSRC antenna and other hardware or software necessary to make the BSM traffic management system 199 a DSRC-enabled device.

The communication unit 245 is coupled to the bus 220 via signal line 246. In some implementations, the communication unit 245 includes a port for direct physical connection to the network 105 or to another communication channel.

For example, the communication unit 245 includes a USB, SD, CAT-5, or similar port for wired communication with the network 105. In some implementations, the communication unit 245 includes a wireless transceiver for exchanging data with the network 105 or other communication channels using one or more wireless communication methods, including IEEE 802.11, IEEE 802.16, BLUETOOTH®, or another suitable wireless communication method.

In some implementations, the communication unit 245 includes a cellular communications transceiver for sending and receiving data over a cellular communications network including via short messaging service (SMS), multimedia messaging service (MMS), hypertext transfer protocol (HTTP), direct data connection, WAP, e-mail, or another suitable type of electronic communication. In some implementations, the communication unit 245 includes a wired port and a wireless transceiver. The communication unit 245 also provides other conventional connections to the network 105 for distribution of files or media objects using standard network protocols including TCP/IP, HTTP, HTTPS, and SMTP, millimeter wave, DSRC, etc.

The storage 241 can be a non-transitory storage medium that stores data for providing the functionality described herein. The storage 241 may be a dynamic random access memory (DRAM) device, a static random access memory (SRAM) device, flash memory, or some other memory devices. In some implementations, the storage 241 also includes a non-volatile memory or similar permanent storage device and media including a hard disk drive, a floppy disk drive, a CD-ROM device, a DVD-ROM device, a DVD-RAM device, a DVD-RW device, a flash memory device, or some other mass storage device for storing information on a more permanent basis. The storage 241 is communicatively coupled to the bus 220 via signal line 242.

In the illustrated implementation shown in FIG. 2, the BSM traffic management system 199 includes a communication module 202, a data module 204, a management module 205 and a graphical user interface module 206 ("GUI module 206"). These components of the BSM traffic management system 199 are communicatively coupled to each other via the bus 220. In some implementations, components of the BSM traffic management system 199 can be stored in a single server or device. In some other implementations, components of the BSM traffic management system 199 can be distributed and stored across multiple servers or devices.

The communication module 202 can be software including routines for handling communications between the BSM traffic management system 199 and other components of the computer system 200. In some implementations, the communication module 202 can be a set of instructions executable by the processor 225 to provide the functionality described below for handling communications between the BSM traffic management system 199 and other components of the computer system 200. In some implementations, the communication module 202 can be stored in the memory 227 of the computer system 200 and can be accessible and executable by the processor 225. The communication module 202 may be adapted for cooperation and communication with the processor 225 and other components of the computer system 200 via signal line 222.

The communication module 202 sends and receives data, via the communication unit 245, to and from one or more of a vehicle, a second BSM traffic management system 199B or some other roadway device that is DSRC-enabled to transmit, broadcast or relay DSRC messages to the BSM traffic management system 199. For example, the communication module 202 receives, via the communication unit 245, a BSM including BSM data from a vehicle, a second BSM traffic management system 199B or some other roadway device that is DSRC-enabled to transmit, broadcast or relay DSRC messages to the BSM traffic management system 199. As described in FIGS. 5 and 6, in some implementations the communication module 202 may send and receive data, via the communication unit 245, with a metering light 524.

In some implementations, the communication module 202 receives data from components of the BSM traffic management system 199 and stores the data in one or more of the storage 241 and the memory 227. For example, the communication module 202 receives BSM data 195 from the communication unit 245 and stores this data in the memory 227.

In some implementations, the communication module 202 may handle communications between components of the BSM traffic management system 199. For example, the communication module 202 receives global positioning data ("GPS data") for a vehicle, heading data for a vehicle or velocity data for a vehicle (as described in FIG. 2B) from the data module 204 and the communication module 202 and stores this data in the memory 227.

In some implementations, each of the vehicles that transmits the BSM is equipped with a DSRC-compliant GPS unit that is operable to provide GPS data that describes the location of the vehicle to a lane-level degree of precision. The DSRC standard requires that GPS data be precise enough to infer if two vehicles are in the same lane. The DSRC-compliant GPS unit may be operable to identify, monitor and track its two-dimensional position within 1.5 meters of its actual position 68% of the time under an open sky. Since lanes are typically no less than 3 meters wide, whenever the 2D error of the GPS data is <1.5 meters the BSM traffic management system 199 described herein may analyze the GPS data and know what lane of the roadway system the vehicle is traveling in based on the relative positions of vehicles on the road For example, the BSM traffic management system 199 may analyze the GPS data and determine that the vehicle is traveling in a first lane 110 versus a second lane 112 or a third lane 114.

The data module 204 can be software including routines for analyzing BSM data 195 to determine one or more of the following for a vehicle based on the BSM data 195 included in a BSM originally transmitted by that vehicle: a location of the vehicle; a speed of the vehicle; a heading of the vehicle. In some implementations, the data module 204 can be stored in the memory 227 of the computer system 200 and can be accessible and executable by the processor 225. The data module 204 may be adapted for cooperation and communication with the processor 225 and other components of the computer system 200 via signal line 224.

In some implementations, the data module 204 may collate the BSM data 195 into different subsets based on the location and heading described by the BSM data 195. For example, with reference to FIG. 1A, one subset of the BSM data 195 is collated to the "North subset" for all vehicles heading in the North direction in a North-bound lane and a different subset of the BSM data 195 is collated to the "South subset" for all vehicles heading in the South direction in a South-bound lane.

In some implementations, the data module 204 may, for each subset described in the preceding paragraph, determine an average speed for the subset. For example, with reference to FIG. 1A, an average speed is determined for the North subset and an average speed is determined for the South subset.

In some implementations, the data module 204 may determine the current heading of traffic in a bidirectional lane. For example, with reference to FIG. 1A, traffic may be flowing in the North bound direction in the second lane 112, which is bidirectional. GPS data included in the BSM data 195 may indicate the heading of a vehicle traveling in the second lane 112. This GPS data may be used to determine the current heading of traffic in the second lane 112. Optionally, an administrator may provide an explicit input to describe the current heading of traffic in the bidirectional lane.

The management module 205 can be software including routines for determining whether to reconfigure a bidirectional lane included in a roadway system based on BSM data 195 received from one or more sets of vehicles traveling along the roadway system. In some implementations, the management module 205 can be stored in the memory 227 of the computer system 200 and can be accessible and executable by the processor 225. The management module 205 may be adapted for cooperation and communication with the processor 225 and other components of the computer system 200 via signal line 280.

In some implementations, the management module 205 may determine the difference in the average speeds for one or more subsets of BSM data 195 created by the data module 204, wherein each subset may be grouped according to lane of travel (e.g., all the Northern-bound lanes) or direction of travel (e.g., North-bound) as described above. The result of this determination may be a first recording of the ADSAOL. Multiple recordings of the ADSAOL may be needed to determine a trend in the ADSAOL. The trend may indicate whether the ADSAOL is it getting bigger (thereby indicating that a reconfiguration of the bidirectional lane may be needed), staying the same (thereby indicating that a reconfiguration of the bidirectional lane may not be needed unless the value of the ADSAOL is greater than some threshold) or getting smaller (thereby indicating that a reconfiguration of the bidirectional lane may not be needed).

For example, with reference to FIG. 1A, the management module 205 may determine an instance of the ADSAOL based on the following analysis:

$$\text{ADSAOL}=(\text{Speed}_{North\ Avg.})-(\text{Speed}_{South\ Avg.}).$$

In some implementations, the management module 205 may determine that if ADSAOL is greater than zero, then this indicates that traffic is traveling slower in the South-bound direction relative to traffic in the North-bound direction. Accordingly, the BSM traffic management system 199 may determine that the second lane 112 may be configured so that traffic flow in the second lane 112 flows toward the South-bound direction, thereby improving traffic flow in the South-bound direction.

In some implementations, the management module 205 may determine that if ADSAOL is less than zero, then this indicates that traffic is traveling slower in the North-bound direction. Accordingly, the BSM traffic management system 199 may determine that the second lane 112 may be configured so that traffic flow in the second lane 112 flows toward the North-bound direction, thereby improving traffic flow in the North-bound direction.

In some implementations, the management module 205 may determine whether there is sufficient data describing the ADSAOL to determine whether to reconfigure the bidirectional lane. For example, the management module 205 may determine multiple calculations of ADSAOL based on different sets of BSM data 195 being analyzed over time to determine if there is a trend in the ADSAOL indicating that the bidirectional lane may be reconfigured.

In some implementations, the management module 205 may require a threshold for ADSAOL to be is exceeded (the threshold may be positive or negative), or that a user setting for a hysteresis be satisfied so that the bidirectional lane is not modified too frequently within a short period of time. Accordingly, the bidirectional lane may not be reconfigured until ADSAOL exceeds some threshold (positive or negative). The threshold may be predetermined by a human administrator of the BSM traffic management system 199. In some implementations, there may also be some hysteresis setting provided by the human administrator that must be satisfied to prevent frequent reconfigurations of the bidirectional lane. For example, the bidirectional lane may not be reconfigured more than once per hour, once per four hours, once per eight hours or once per day. The memory 227 may store settings data for the hysteresis setting or the threshold setting.

In some implementations, the management module 205 may determine more instances of ADSAOL if one or more of the following is true: there is not enough data to identify a trend; the threshold for ADSAOL is not satisfied; modifying the bidirectional lane would violate the hysteresis setting.

In some implementations, the management module 205 may analyze the values of the one or more calculations of ADSAOL to determine if, based on the trend presented therein, the heading of traffic in the bidirectional lane should be changed to minimize or reduce the ADSAOL. For example, with reference to FIG. 1A, if (1) the bidirectional lane is configured so that traffic flows in the North bound direction and (2) ADSAOL is consistently higher than zero (and possibly above a threshold that would indicate the ADSAOL is significant), then the bidirectional lane may be reconfigured so that traffic flows in the South bound direction. It will be understood that in some implementations the ADSAOL may be a negative number. In these implementations, the value for the ADSAOL may be multiplied by negative one to achieve an absolute value for ADSAOL that is suitable for analysis by the management module 205.

In some implementations, reducing the ADSAOL may include identifying that reconfiguring the bidirectional lane would result in a value of ADSAOL that is closer to zero than the current value of ADSAOL.

In some implementations, the management module 205 may provide instructions to a manager of the roadway system to reconfigure the bidirectional lane so that traffic flows in the opposite direction relative to the present configuration of the bidirectional lane. These instructions may include a signal that is transmitted by the communication unit 245. The signal may cause an audible or visible signal to the manager of the roadway system to indicate that the bidirectional lane may be reconfigured.

In some implementations, the management module 205 may provide some or all of the functionality described below with reference to managing metering lights.

The GUI module 206 can be software including routines for providing a signal including graphical data to a client device to indicate a decision of the management module 205 (e.g., reconfigure the bidirectional lane, modify the metering of the metering light, etc.). In some implementations, the GUI module 206 can be stored in the memory 227 of the computer system 200 and can be accessible and executable by the processor 225. The GUI module 206 may be adapted for cooperation and communication with the processor 225 and other components of the computer system 200 via signal line 226.

The GUI module 206 may determine the graphical data. The graphical data may cause a display associated with the client device to provide a GUI that is viewable by the manager of the roadway system. The GUI may graphically depict the ADSAOL and the recommendation to reconfigure the bidirectional lane. Although not depicted in FIG. 2A, the graphical data (or "GUI data") may be stored in the memory 227.

Referring now to FIG. 2B, depicted is a block diagram illustrating an example of BSM data 195 according to some implementations.

The regular interval for transmitting BSMs may be user configurable. In some implementations, a default setting for this interval may be transmitting the BSM every 0.10 seconds or substantially every 0.10 seconds.

A BSM may be broadcasted over the 5.9 GHz DSRC band. DSRC range may be substantially 1,000 meters. In some implementations, DSRC range may include a range of substantially 100 meters to substantially 1,000 meters.

Referring now to FIG. 2C, depicted is a block diagram illustrating an example of BSM data 195 according to some implementations.

A BSM may include two parts. These two parts may include different BSM data 195 as shown in FIG. 2C.

Part 1 of the BSM data 195 may describe one or more of the following: vehicle position; vehicle heading; vehicle speed; vehicle acceleration; vehicle steering wheel angle; and vehicle size.

Part 2 of the BSM data 195 may include a variable set of data elements drawn from a list of optional elements. Some of the BSM data 195 included in Part 2 of the BSM are selected based on event triggers, e.g., anti-locking brake system ("ABS") being activated may trigger BSM data 195 relevant to the ABS system of the vehicle.

In some implementations, some of the elements of Part 2 are transmitted less frequently in order to conserve bandwidth.

In some implementations, the BSM data 195 included in a BSM includes current snapshots of a vehicle traveling along a roadway system.

FIGS. 3A to 3D are a flowchart of an example method 300 for managing traffic on a roadway system based on BSM data 195 describing vehicles traveling along the roadway system according to some implementations.

At step 302, the BSM traffic management system 199 may receive a first set of BSM. Each BSM includes BSM data 195. The first set of BSM includes numerous instances of BSM data 195 for each vehicle within DSRC range of the BSM traffic management system 199 since each vehicle broadcasts a BSM at a regular interval.

At step 304, the BSM traffic management system 199 may, for each BSM included in the set of BSM received at step 302, determine one or more of the following: (a) the location of the vehicle; (2) the speed of the vehicle; and (3) the heading of the vehicle. The BMS includes BSM data 195 that describes the location, speed and heading of the vehicle that transmitted the BSM.

At step 306, the BSM traffic management system 199 may collate the BSM data 195 into different subsets based on location and heading. Element 307 describes an example of step 306 according to some implementations. At element 307, one subset of the BSM data 195 is collated to the "North subset" for all vehicles heading in the North direction in a North-bound lane and a different subset of the BSM data 195 is collated to the "South subset" for all vehicles heading in the South direction in a South-bound lane.

At step 308, the BSM traffic management system 199 may, for each subset in step 306, determine an average speed for the subset. Element 309 describes an example of step 308 according to some implementations. At element 309, an average speed is determined for the North subset and an average speed is determined for the South subset.

Figure 3A:
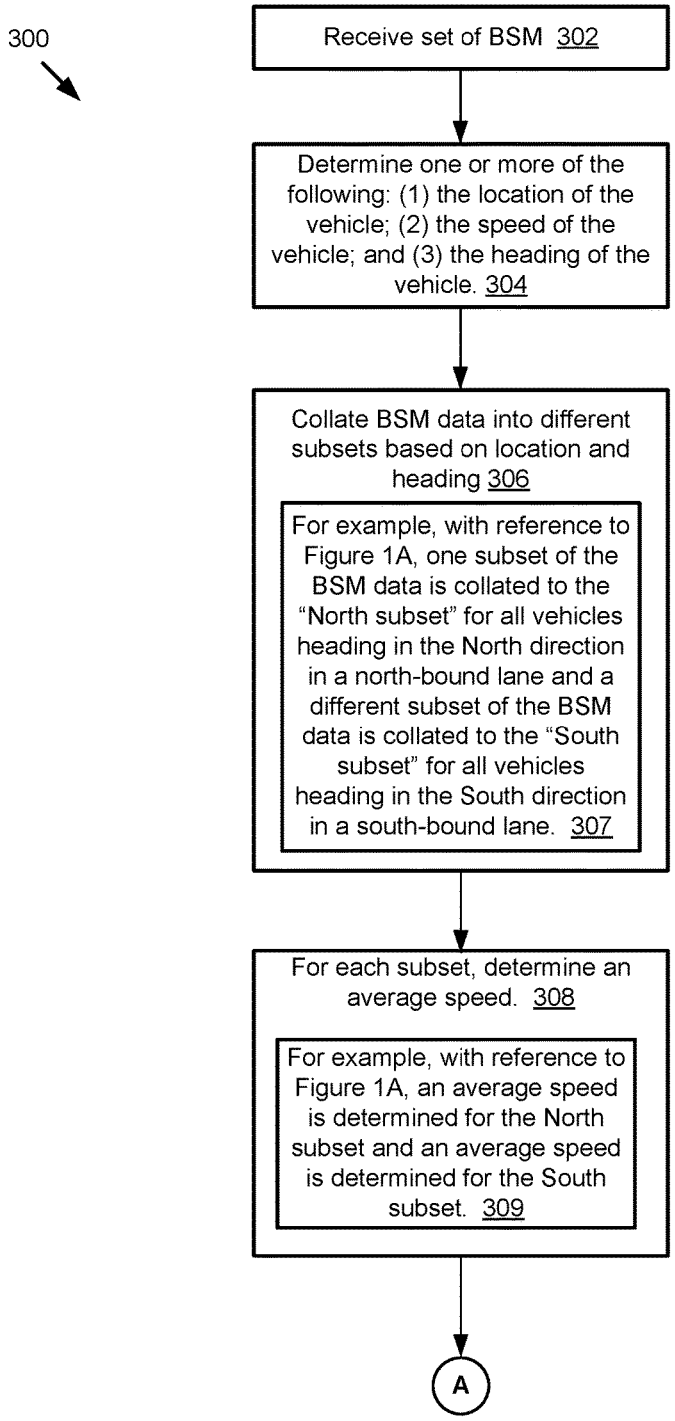
FIGS. 3A to 3D are a flowchart of an example method for managing traffic on a roadway system based on BSM data describing vehicles traveling along the roadway system according to some implementations.
Figure 3B:
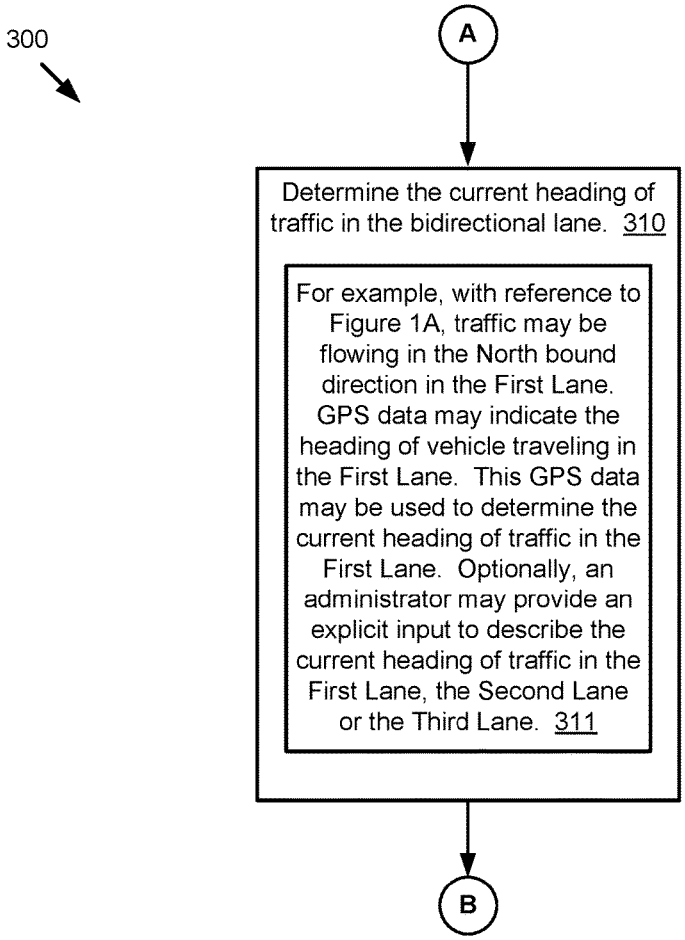

Referring now to FIG. 3B. At step 310, the BSM traffic management system 199 may determine the current heading of traffic in the bidirectional lane. Element 311 describes an example of step 310 according to some implementations. Element 311 refers to FIG. 1A by way of example. At element 311, with reference to FIG. 1A, traffic may be flowing in the North bound direction in the second lane 112, which is bidirectional. GPS data included in the BSM data 195 may indicate the heading of a vehicle traveling in the second lane 112. This GPS data may be used to determine the current heading of traffic in the second lane 112. Optionally, an administrator may provide an explicit input to describe the current heading of traffic in the bidirectional lane.

Figure 3C:
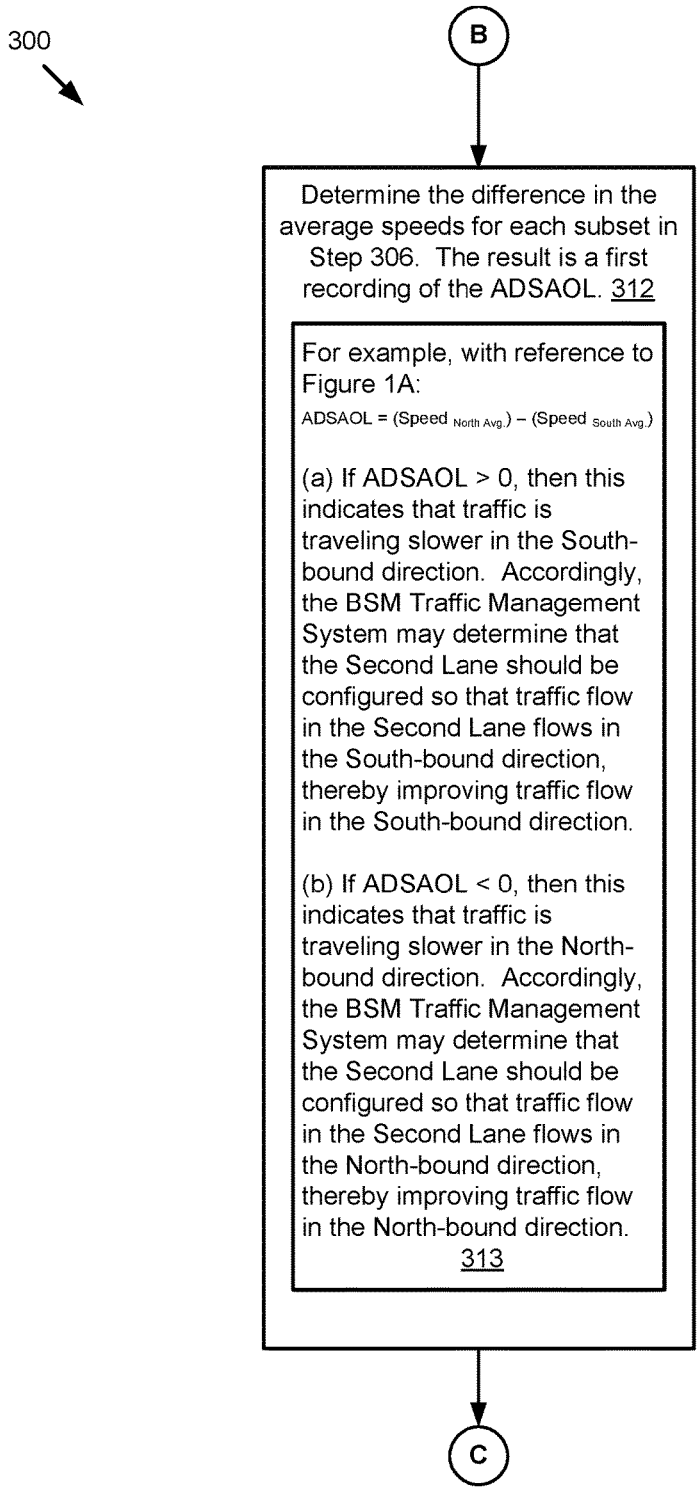

Referring now to FIG. 3C. At step 312, the BSM traffic management system 199 may determine the difference in the average speeds for each subset in step 306. The result of step 312 is a first recording of the ADSAOL. Element 313 describes an example of step 312 according to some implementations. Element 313 refers to FIG. 1A by way of example. At element 313, the following analysis may be used by the BSM traffic management system 199:

$$\text{ADSAOL}=(\text{Speed}_{North\ Avg.})-(\text{Speed}_{South\ Avg.}).$$

At element 313, if ADSAOL is greater than zero, then this indicates that traffic is traveling slower in the South-bound direction relative to traffic in the North-bound direction. Accordingly, the BSM traffic management system 199 may determine that the second lane 112 may be configured so that traffic flow in the second lane 112 flows toward the South-bound direction, thereby improving traffic flow in the South-bound direction.

At element 313, if ADSAOL is less than zero, then this indicates that traffic is traveling slower in the North-bound direction. Accordingly, the BSM traffic management system 199 may determine that the second lane 112 may be configured so that traffic flow in the second lane 112 flows toward the North-bound direction, thereby improving traffic flow in the North-bound direction.

Figure 3D:
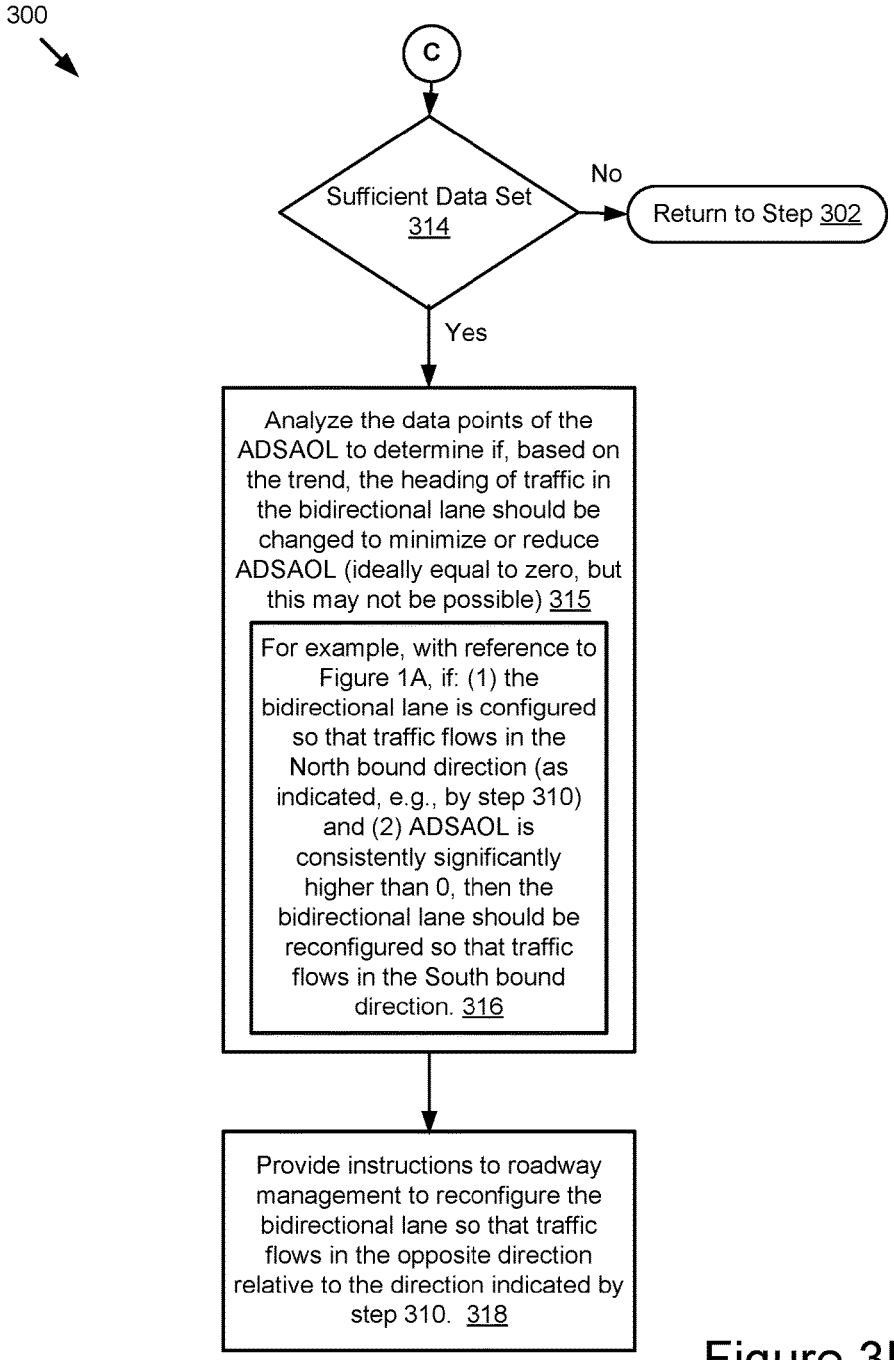

Referring now to FIG. 3D. At step 314, the BSM traffic management system 199 may determine whether there is sufficient data describing the ADSAOL to determine whether to reconfigure the bidirectional lane. Step 314 may include ensuring that there are multiple calculations of ADSAOL based on different sets of BSM data 195 being analyzed (i.e., greater than one calculation of ADSAOL, or enough calculations of ADSAOL to create identify whether there is a trend; three of more calculations may be sufficient to identify a trend in some implementations), that a threshold for ADSAOL is exceeded (the threshold may be positive or negative), or that a user setting for a hysteresis is satisfied so that the bidirectional lane is not modified too frequently within a short period of time.

Accordingly, the bidirectional lane may not be reconfigured until ADSAOL exceeds some threshold (positive or negative). The threshold may be predetermined by a human administrator of the BSM traffic management system 199. In some implementations, there may also be some hysteresis setting provided by the human administrator that must be satisfied to prevent frequent reconfigurations of the bidirectional lane. For example, the bidirectional lane may not be reconfigured more than once per hour, once per four hours, once per eight hours or once per day. The memory 227 may store settings data for the hysteresis setting or the threshold setting.

If there is not sufficient data at step 314 (or the threshold setting is not satisfied or the hysteresis setting is not satisfied), then the method 300 may proceed to step 302.

If there is sufficient data at step 314 (or the threshold setting is satisfied or the hysteresis setting is satisfied), then the method 300 may proceed to step 315.

At step 315, the BSM traffic management system 199 may analyze the data points of ADSAOL to determine if, based on the trend, the heading of traffic in the bidirectional lane should be changed to minimize or reduce the ADSAOL. Element 316 includes an example of step 315. Element 316 refers to FIG. 1A by way of example. At element 316, if (1) the bidirectional lane is configured so that traffic flows in the North bound direction (as indicated by step 310) and (2) ADSAOL is consistently higher than zero (and possibly above a threshold that would indicate the ADSAOL is significant), then the bidirectional lane may be reconfigured so that traffic flows in the South bound direction. It will be understood that in some implementations the ADSAOL may be a negative number. In these implementations, the value for the ADSAOL may be multiplied by negative one to achieve an absolute value for ADSAOL that is suitable for analysis under step 315.

At step 318, the BSM traffic management system 199 may provide instructions to roadway management to reconfigure the bidirectional lane so that traffic flows in the opposite direction relative to the direction indicated by step 310 or element 311. This signal may include a graphical user interface ("GUI") that is transmitted to a client device that is viewable by the manager of the roadway system. The GUI may graphically depict the ADSAOL and the recommendation to reconfigure the bidirectional lane.

Figure 4:
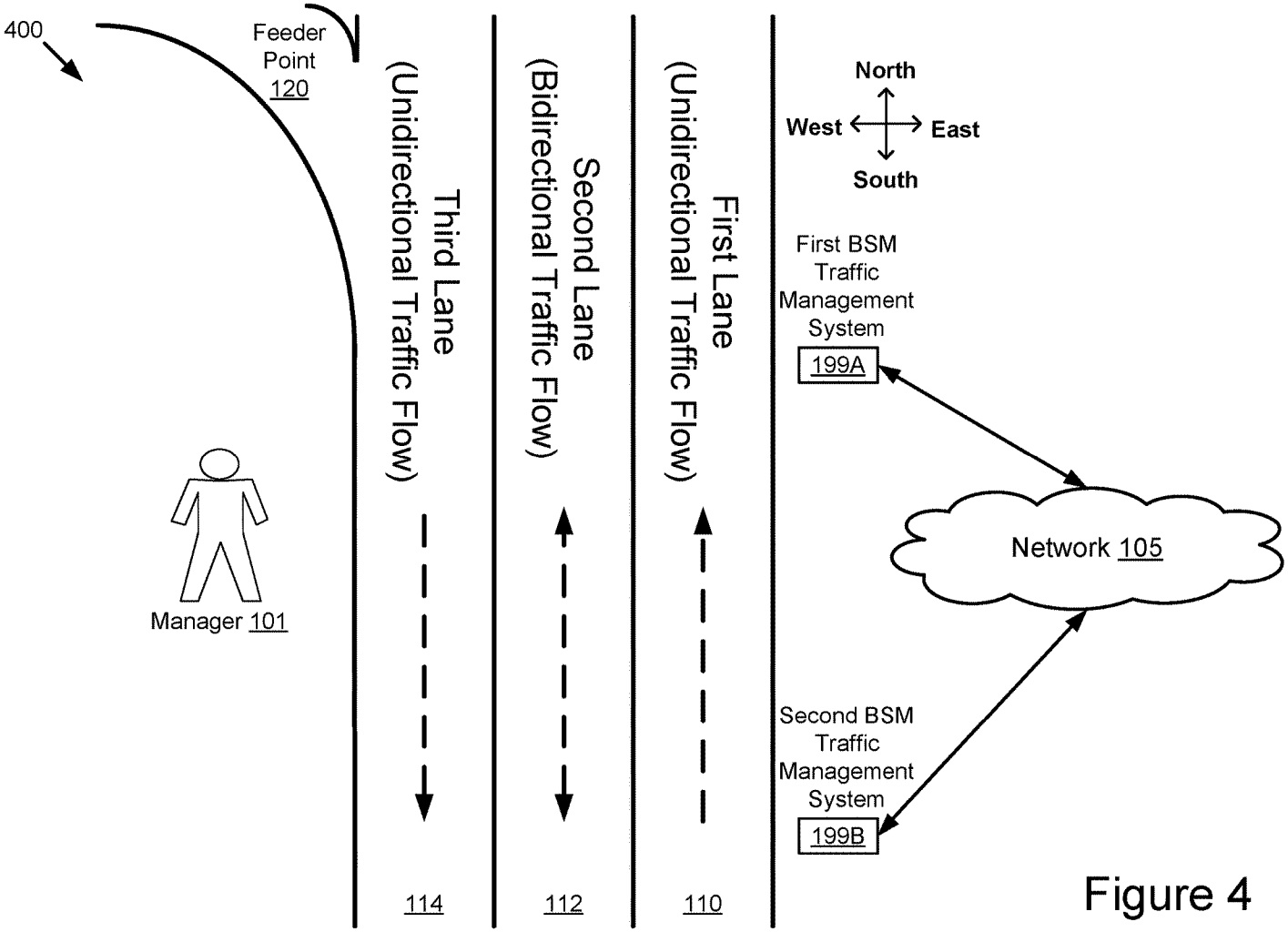
FIG. 4 is a block diagram illustrating a second example operating environment for a set of BSM traffic management systems according to some implementations.

FIG. 4 is a block diagram illustrating a second example operating environment 400 for a set of BSM traffic management systems 199 according to some implementations. FIG. 4 includes two BSM traffic management systems 199A and 199B (referred to individually as "the first BSM traffic management system 199A" and the "second BSM traffic management system 199B" or collectively as "the BSM traffic management system 199").

The third lane 114 includes a feeder point 120. The feeder point 120 includes a feeder that feeds additional vehicles into the third lane 114. The feeder point 120, the third lane 114, the second lane 112 and the first lane 110 are all elements of the roadway system.

The operating environment also includes a network 105. The first BSM traffic management system 199A and the second BSM traffic management system 199B are communicatively coupled to one another via the network 105.

In some implementations, the vehicles traveling along the roadway system may be communicatively coupled to the network 105. The vehicles may communicate with one another via the network 105. The vehicles may communicate with the first BSM traffic management system 199A or the second BSM traffic management system 199B via the network 105. For example, a first vehicle that is outside of DSRC range of either of the BSM traffic management systems 199 may broadcast a BSM that is received by a second vehicle that is within range of one of the BSM traffic management systems 199. The second vehicle may then relay the BSM of the first vehicle to one of the BSM traffic management systems 199. Similarly, the first BSM traffic management system 199A may relay BSMs to the second BSM traffic management system 199B and vice-versa.

The network 105 can be a conventional type, wired or wireless, and may have numerous different configurations including a star configuration, token ring configuration, or other configurations. Furthermore, the network 105 may include a local area network (LAN), a wide area network (WAN) (e.g., the Internet), or other interconnected data paths across which multiple devices may communicate. In some implementations, the network 105 may be a peer-to-peer network. The network 105 may also be coupled to or includes portions of a telecommunications network for sending data in a variety of different communication protocols. In some implementations, the network 105 includes Bluetooth communication networks or a cellular communications network for sending and receiving data including via DSRC, short messaging service (SMS), multimedia messaging service (MMS), hypertext transfer protocol (HTTP), direct data connection, WAP, e-mail, millimeter wave communication, etc.

As described above, the feeder point 120 supplies the third lane 114 with traffic. The first BSM traffic management system 199A is located at the proximate location of the feeder point 120. The first BSM traffic management system 199A is communicatively coupled to the second BSM traffic management system 199B via the network 105. The feeder point 120 may be at a remote location from the second BSM traffic management system 199B. For example, the feeder point 120 may be one or more miles from the second BSM traffic management system 199B, and so, the traffic activity associated with the feeder point 120 may not be observable by the second BSM traffic management system 199B. However, activity at the feeder point 120 may affect traffic that is observable by the first BSM traffic management system 199A. In some implementations, the first BSM traffic management system 199A may transmit one or more sets of BSM data 195 to the second BSM traffic management system 199B. The second BSM traffic management system 199B may use this BSM data 195 to determine how to manage the flow of traffic in the second lane 112.

FIG. 4 depicts one example reason why there might be multiple BSM traffic management systems 199 working cooperatively, i.e. the existence of a feeder point 120 that is located remotely (e.g., outside of DSRC range). Another reason for deploying multiple BSM traffic management systems 199 is that on a high-speed road the scope of the lane direction change will likely be longer than the reception range of a single system, even if no feeder point 120 is needed. For example, on a highway, a bidirectional lane may span one or more miles. In such a case, one BSM traffic management system 199 could still make the decision about whether to reconfigured the bidirectional lane based only on locally received BSMs, or multiple BSM traffic management systems 199 could monitor BSMs on multiple portions of the bidirectional lane and share the information with one "master" BSM traffic management system 199 that makes the lane direction decision for all the other BSM traffic management systems 199 that monitor the bidirectional lane.

Figure 5:
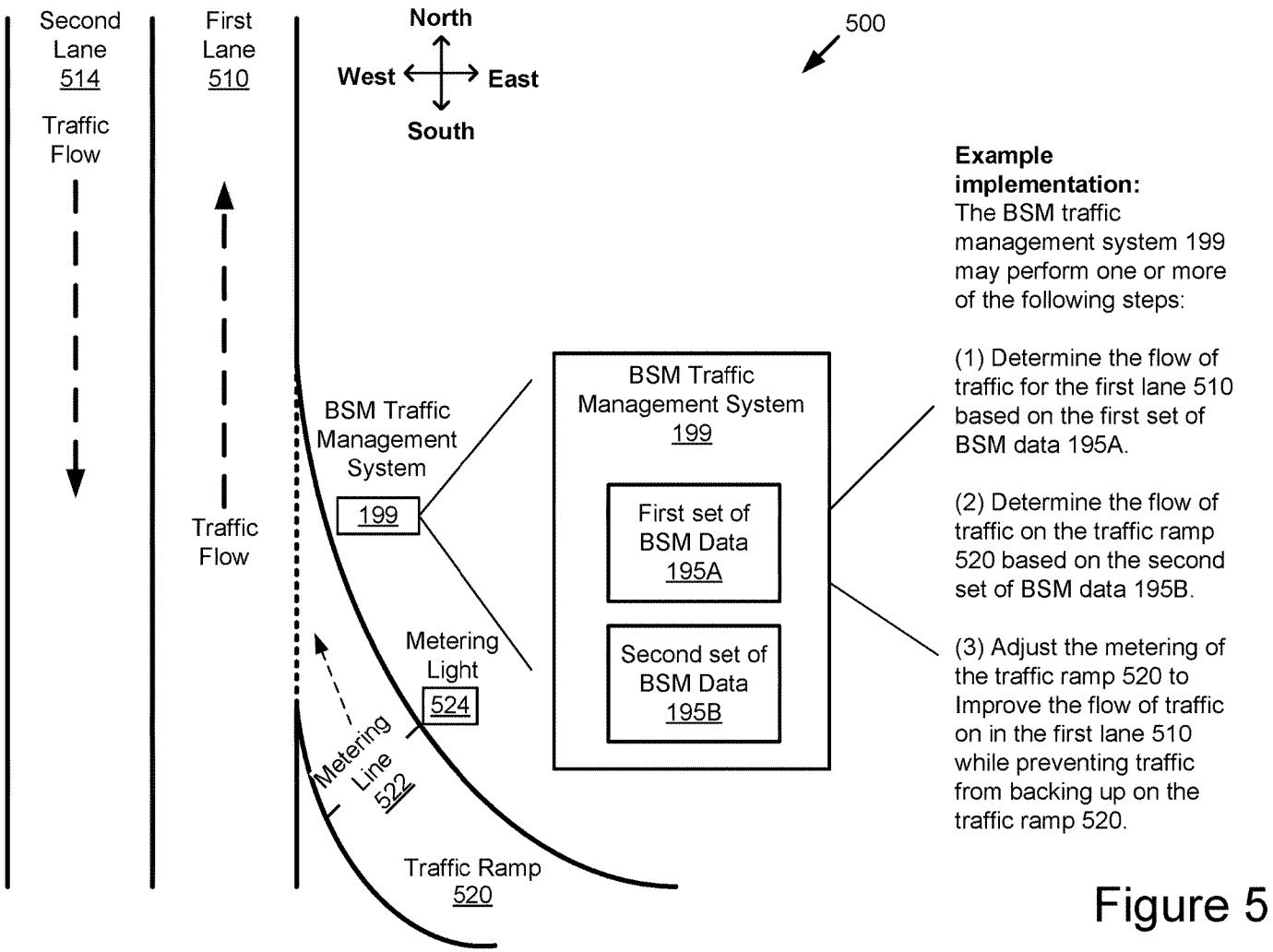
FIG. 5 is a block diagram illustrating a third example operating environment for a BSM traffic management system according to some implementations.

Referring now to FIG. 5, depicted is a block diagram illustrating a third example operating environment 500 for a BSM traffic management system 199 according to some implementations. This operating environment 500 includes a BSM traffic management system 199, a traffic ramp 520, a metering line 522, a metering light 524, a first lane 510 and a second lane 514.

A metering light 524 is a device that may include a basic traffic light or a two-section signal (red and green only, no yellow) light together with a signal controller. The metering light 524 may regulate the flow of traffic entering the first lane 510. The metering line 522, is a visible line along the traffic ramp 520 where traffic cannot legally pass while the metering light 524 provides a visual indication to vehicles on the traffic ramp 520 that they may not pass the metering line 522. The visual indication may be a red light.

The metering light 524 may regulate the flow of traffic entering the first lane 510 based on current traffic conditions. For example, the metering light 524 may be controlled by the BSM traffic management system 199 and the BSM traffic management system 199 may cause the metering light 524 to regulate the flow of traffic entering the first lane based on a first set of BSM data 195A describing vehicles traveling on the traffic ramp 520 and a second set of BSM data 195B describing traffic traveling along the first lane 510.

In some implementations, vehicles traveling in the first lane 510 may broadcast BSMs including the first set of BSM data 195A and the BSM traffic management system 199 may receive the BSMs and identify the first set of BSM data 195A included in these BSMs as being associated with the first lane based on the GPS data included in the BSMs that describes the location of the vehicles as traveling in the first lane 510.

In some implementations, vehicles traveling in the traffic ramp 520 may broadcast BSMs including the second set of BSM data 195B and the BSM traffic management system 199 may receive the BSMs and identify the second set of BSM data 195B included in these BSMs as being associated with the traffic ramp 520 based on the GPS data included in the BSMs that describes the location of the vehicles as traveling in the traffic ramp 520.

In some implementations, the BSM traffic management system 199 may determine the flow of traffic for the first lane 510 based on the first set of BSM data 195A. The flow of traffic may describe one or more of the following: the heading of the traffic in the first lane 510; the speed of the traffic in the first lane 510; and the density of traffic in the first lane 510 based on the amount of BSMs received from unique vehicles. The BSM traffic management system 199 may determine the flow of traffic for the traffic ramp 520 based on the second set of BSM data 195B. The BSM traffic management system 199 may be communicatively coupled to the metering light via a wireless network (e.g., network 105) or a hardwired connection. The BSM traffic management system 199 may be operable to provide a signal to the metering light to adjust the metering of the traffic ramp 520 based on the first set of BSM data 195A and the second set of BSM data 195B.

Figure 6:
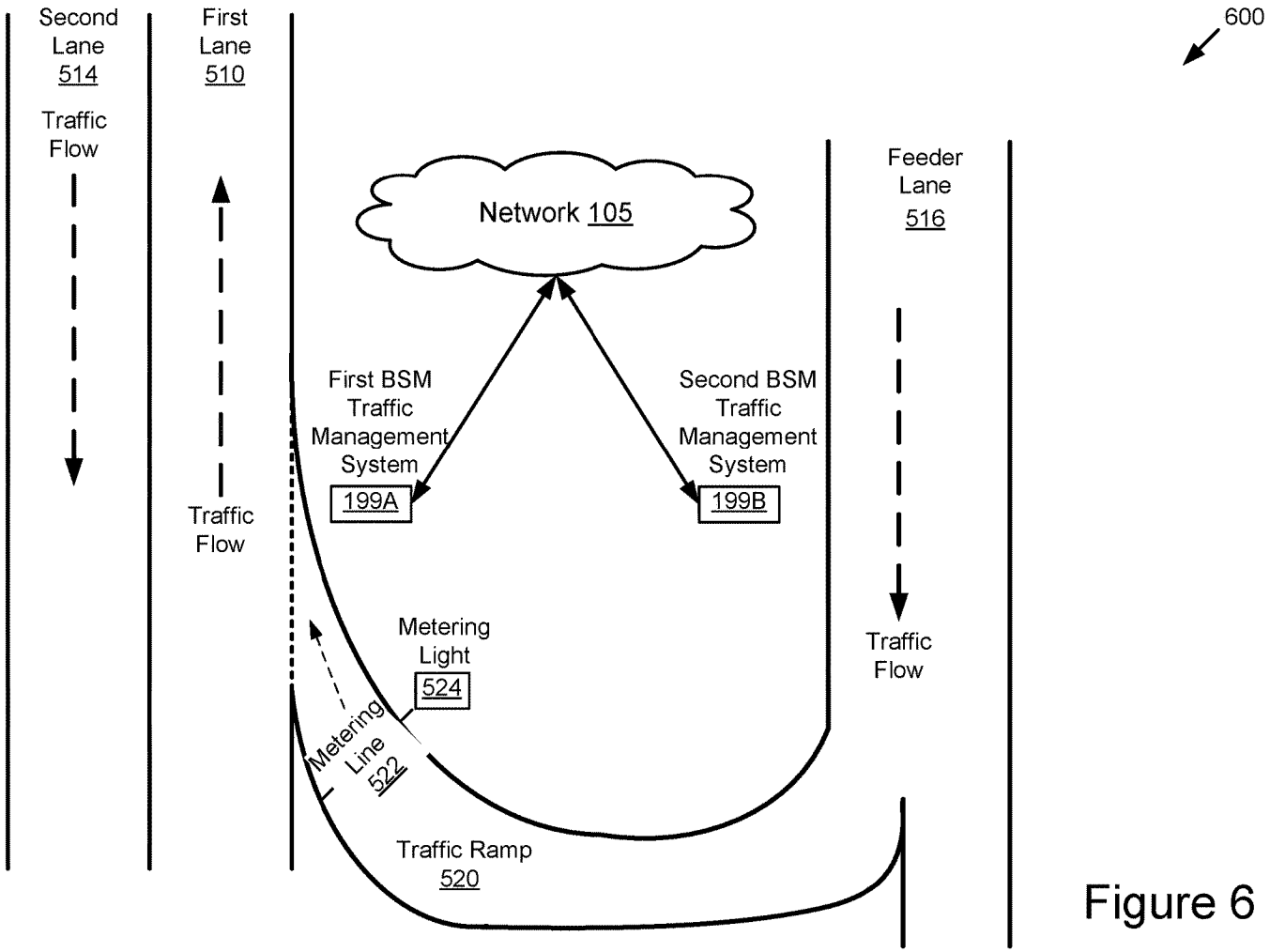
FIG. 6 is a block diagram illustrating a fourth example operating environment for a set of BSM traffic management systems according to some implementations.

Referring now to FIG. 6, depicted is a block diagram illustrating a fourth example operating environment 600 for a set of BSM traffic management systems 199 according to some implementations. This operating environment 600 includes a first BSM traffic management system 199A, a second BSM traffic management system 199B, a traffic ramp 520, a metering line 522, a metering light 524, a first lane 510 and a second lane 514 and a feeder lane 516. The first BSM traffic management system 199A and the second BSM traffic management system 199B are communicatively coupled via a network 105. The network 105 was described above with reference to FIG. 4, and so, that description will not be repeated here.

In some implementations, the first BSM traffic management system 199A may be operable to ensure that stalled traffic on the traffic ramp 520 does not cause traffic to back up in the feeder lane 516. However, in this implementation assume that the first BSM traffic management system 199A cannot observe traffic in the feeder lane 516, since, in practice these locations may be separate by a distance that is greater than the range of DSRC. The second BSM traffic management system 199B may transmit BSM data describing vehicles traveling along the feeder lane 516 to the first BSM traffic management system 199A via the network 105. Using this BSM data, the first BSM traffic management system 199A may determine how metering of the traffic ramp 520 affects traffic flow in the feeder lane 516 and modify the metering of the traffic ramp 520 to improve traffic flow in one or more of the following: the first lane 510; the traffic ramp 520; and the feeder lane 516.

Accordingly, first BSM traffic management system 199A may provide two functions: (1) optimizing traffic flow; and (2) preventing traffic from backing up in the feeder lane 516. Optionally, a human manager of the first BSM traffic management system 199A may configure the first BSM traffic management system 199A prioritize one of these functions over the other. For example, the human manager may configure the first BSM traffic management system 199A to prioritize optimization of traffic flow in one or more of the first lane 510 and the traffic ramp 520 over preventing traffic from backing up in the feeder lane 516. In another example, the human manager may configure the first BSM traffic management system 199A to prioritize preventing traffic from backing up in the feeder lane 516 over optimization of traffic flow in the first lane 510 or the traffic ramp 520. In another example, these two functions may be equally favored by the first BSM traffic management system 199A.

In some implementations, the second BSM traffic management system 199B may not be needed in the operating environment 600 if the goal is only to improve the flow of traffic in the first lane 510 and not to improve traffic in the feeder lane 516.

In some implementations, one or more elements of the BSM traffic management system 199 may be implemented using hardware including a field-programmable gate array ("FPGA") or an application-specific integrated circuit ("ASIC"). In some other implementations, the BSM traffic management system 199 may be implemented using a combination of hardware and software. The BSM traffic management system 199 is described in more detail below with reference to FIGS. 2-5.

In the above description, for purposes of explanation, numerous specific details are set forth in order to provide a thorough understanding of the specification. It will be apparent, however, to one skilled in the art that the disclosure can be practiced without these specific details. In some instances, structures and devices are shown in block diagram form in order to avoid obscuring the description. For example, the present implementations can be described above primarily with reference to user interfaces and particular hardware. However, the present implementations can apply to any type of computing device that can receive data and commands, and any peripheral devices providing services.

Reference in the specification to "some implementations" or "some instances" means that a particular feature, structure, or characteristic described in connection with the implementations or instances can be included in at least one implementation of the description. The appearances of the phrase "in some implementations" in various places in the specification are not necessarily all referring to the same implementations.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms including "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

The present implementations of the specification can also relate to an apparatus for performing the operations herein. This apparatus may be specially constructed for the required purposes, or it may include a general-purpose computer selectively activated or reconfigured by a computer program stored in the computer. Such a computer program may be stored in a computer-readable storage medium, including, but is not limited to, any type of disk including floppy disks, optical disks, CD-ROMs, and magnetic disks, read-only memories (ROMs), random access memories (RAMs), EPROMs, EEPROMs, magnetic or optical cards, flash memories including USB keys with non-volatile memory, or any type of media suitable for storing electronic instructions, each coupled to a computer system bus.

The specification can take the form of some entirely hardware implementations, some entirely software implementations or some implementations containing both hardware and software elements. In some preferred implementations, the specification is implemented in software, which includes, but is not limited to, firmware, resident software, microcode, etc.

Furthermore, the description can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device.

A data processing system suitable for storing or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including, but not limited, to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem, and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the specification is not described with reference to any particular programming language. It will be appreciated that a variety of programming languages may be used to implement the teachings of the specification as described herein.

The foregoing description of the implementations of the specification has been presented for the purposes of illustration and description. It is not intended to be exhaustive or to limit the specification to the precise form disclosed. Many modifications and variations are possible in light of the above teaching. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies, and other aspects are not mandatory or significant, and the mechanisms that implement the specification or its features may have different names, divisions, or formats. Furthermore, as will be apparent to one of ordinary skill in the relevant art, the modules, routines, features, attributes, methodologies, and other aspects of the disclosure can be implemented as software, hardware, firmware, or any combination of the three. Also, wherever a component, an example of which is a module, of the specification is implemented as software, the component can be implemented as a standalone program, as part of a larger program, as a plurality of separate programs, as a statically or dynamically linked library, as a kernel-loadable module, as a device driver, or in every and any other way known now or in the future to those of ordinary skill in the art of computer programming. Additionally, the disclosure is in no way limited to implementation in any specific programming language, or for any specific operating system or environment. Accordingly, the disclosure is intended to be illustrative, but not limiting, of the scope of the specification, which is set forth in the following claims.

What is claimed is:

1. A method of managing traffic lanes, including a first lane having traffic flowing towards a first heading, a second lane having traffic flowing towards a second heading, and a third lane that is configurable to have traffic flowing towards either the first heading or the second heading, wherein the first heading is different from the second heading, the method comprising:

wirelessly receiving, by a dedicated short range communication ("DSRC") antenna, messages from vehicles traveling on the first lane, the second lane, or the third lane, wherein each message includes data describing a particular lane of travel for a specific vehicle, a speed of travel for the specific vehicle, and a heading of travel for the specific vehicle;

determining, by a processor, based on the messages, that traffic in the first lane flowing towards the first heading and traffic in the second lane flowing towards the second heading are imbalanced; and controlling, by the DSRC antenna, a traffic light to reconfigure the traffic light to allow traffic in the third lane to change flow towards a different heading from an initial heading.

2. The method of claim 1, wherein the messages are basic safety messages ("BSMs").

3. The method of claim 1, wherein determining that traffic in the first lane flowing towards the first heading and traffic in the second lane flowing towards the second heading are imbalanced is based on:

analyzing the data to determine a first value for an Average Differential Speed Among Opposing Lanes of traffic ("ADSAOL"); and analyzing the ADSAOL to determine whether reconfiguring the third lane to change flow towards the different heading would result in a second value for the ADSAOL that is closer to zero when compared to the first value.

4. The method of claim 3, wherein the third lane is reconfigured if doing so would result in the second value being substantially zero.

5. The method of claim 3, wherein analyzing the data to determine the first value for the ADSAOL includes determining that the first value for the ADSAOL exceeds a threshold value.

6. The method of claim 1, wherein the second lane includes a feeder point that delivers traffic traveling in the second lane.

7. The method of claim 1, further comprising:

determining, based on a hysteresis setting, that the traffic light for the third lane has been reconfigured a maximum number of times for a predetermined time period; and denying a request to reconfigure the traffic light for the third lane until the predetermined time period ends.

8. A non-transitory computer-readable medium of managing traffic lanes, including a first lane having traffic flowing towards a first heading, a second lane having traffic flowing towards a second heading, and a third lane that is configurable to have traffic flowing towards either the first heading or the second heading, wherein the first heading is different from the second heading, the computer-readable medium having computer instructions stored thereon that are executable by a processing device to perform or control performance of steps comprising:

wirelessly receiving, by a dedicated short range communication ("DSRC") antenna, messages from vehicles traveling on the first lane, the second lane, or the third lane, wherein each message includes data describing a particular lane of travel for a specific vehicle, a speed of travel for the specific vehicle, and a heading of travel for the specific vehicle;

determining, by a processor, based on the messages, that traffic in the first lane flowing towards the first heading and traffic in the second lane flowing towards the second heading are imbalanced; and controlling, by the DSRC antenna, a traffic light to reconfigure the traffic light to allow traffic in the third lane to change flow towards a different heading from an initial heading.

9. The non-transitory computer-readable medium of claim 8, wherein the messages are basic safety messages ("BSMs").

10. The non-transitory computer-readable medium of claim 8, wherein determining that traffic in the first lane flowing towards the first heading and traffic in the second lane flowing towards the second heading are imbalanced is based on:

analyzing the data to determine a first value for an Average Differential Speed Among Opposing Lanes of traffic ("ADSAOL"); and analyzing the ADSAOL to determine whether reconfiguring the third lane to change flow towards the different heading would result in a second value for the ADSAOL that is closer to zero when compared to the first value.

11. The non-transitory computer-readable medium of claim 10, wherein the third lane is reconfigured if doing so would result in the second value being substantially zero.

12. The non-transitory computer-readable medium of claim 10, wherein analyzing the data to determine the first value for the ADSAOL includes determining that the first value for the ADSAOL exceeds a threshold value.

13. The non-transitory computer-readable medium of claim 8, wherein the second lane includes a feeder point that delivers traffic traveling in the second lane.

14. The non-transitory computer-readable medium of claim 8, the steps further comprising:

determining, based on a hysteresis setting, that the traffic light for the third lane has been reconfigured a maximum number of times for a predetermined time period; and denying a request to reconfigure the traffic light for the third lane until the predetermined time period ends.

15. A system of managing traffic lanes, including a first lane having traffic flowing towards a first heading, a second lane having traffic flowing towards a second heading, and a third lane that is configurable to have traffic flowing towards either the first heading or the second heading, wherein the first heading is different from the second heading, the system comprising:

a memory storing instructions that, when executed by a processor, cause the system to:

wirelessly receive, by a dedicated short range communication ("DSRC") antenna, messages from vehicles traveling on the first lane, the second lane, or the third lane, wherein each message includes data describing a particular lane of travel for a specific vehicle, a speed of travel for the specific vehicle, and a heading of travel for the specific vehicle;

determine based on the messages, that traffic in the first lane flowing towards the first heading and traffic in the second lane flowing towards the second heading are imbalanced; and control, by the DSRC antenna, a traffic light to reconfigure the traffic light to allow traffic in the third lane to change flow towards a different heading from an initial heading.

16. The system of claim 15, wherein the messages are basic safety messages ("BSMs").

17. The system of claim 15, wherein determining that traffic in the first lane flowing towards the first heading and traffic in the second lane flowing towards the second heading are imbalanced is based on:

analyzing the data to determine a first value for an Average Differential Speed Among Opposing Lanes of traffic ("ADSAOL"); and analyzing the ADSAOL to determine whether reconfiguring the third lane to change flow towards the different heading would result in a second value for the ADSAOL that is closer to zero when compared to the first value.

18. The system 17, wherein the third lane is reconfigured if doing so would result in the second value being substantially zero.

19. The system of claim 17, wherein analyzing the data to determine the first value for the ADSAOL includes determining that the first value for the ADSAOL exceeds a threshold value.

20. The system of claim 15, wherein the second lane includes a feeder point that delivers traffic traveling in the second lane.

* * * * *